US006321521B1

(12) United States Patent
Burchert

(10) Patent No.: US 6,321,521 B1
(45) Date of Patent: Nov. 27, 2001

(54) PROCESS AND APPARATUS FOR CLEANING AN OPEN-END SPINNING ROTOR

(75) Inventor: Mathias Burchert, Deggingen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 9 days.

(21) Appl. No.: 09/710,880

(22) Filed: Nov. 14, 2000

(30) Foreign Application Priority Data

Nov. 23, 1999 (DE) ..... 199 56 264

(51) Int. Cl.[7] ..... D01H 13/26
(52) U.S. Cl. ..... 57/263; 57/301
(58) Field of Search ..... 57/261, 263, 264, 57/300, 301, 302, 401, 404

(56) References Cited

U.S. PATENT DOCUMENTS

| | | | | |
|---|---|---|---|---|
| 3,481,129 | | 12/1969 | Shepherd et al. | 57/58.89 |
| 4,038,812 | * | 8/1977 | Stahlecker | 57/301 |
| 4,249,369 | * | 2/1981 | Tsuzuki et al. | 57/263 |
| 4,384,451 | * | 5/1983 | Elias et al. | 57/263 |
| 4,497,166 | * | 2/1985 | Artzt et al. | 57/263 |
| 4,539,808 | * | 9/1985 | Miyamoto et al. | 57/411 |
| 4,825,631 | | 5/1989 | Raasch | 57/263 |
| 5,535,580 | * | 7/1996 | Sebastian et al. | 57/263 |
| 5,640,838 | * | 6/1997 | Billner et al. | 57/263 |
| 5,787,699 | * | 8/1998 | Morishita et al. | 57/263 |
| 6,035,622 | * | 3/2000 | Fox et al. | 57/263 |

FOREIGN PATENT DOCUMENTS 41 31 684 3/1993 (DE) .

* cited by examiner

*Primary Examiner*—Danny Worrell
(74) *Attorney, Agent, or Firm*—Crowell & Moring LLP

(57) ABSTRACT

For the purpose of cleaning an open-end spinning rotor, the fiber feed is usually interrupted and the open-end spinning rotor slowed down. Subsequently, in the case of many embodiments, after a cover is removed from the vacuum chamber, cleaning elements are inserted into the exposed rotor cup. According to the present invention, it is provided that before the open-end spinning rotor is actually uncovered, namely before it comes to a standstill, the cover is moved just a short distance away from the vacuum chamber and thereafter, that the vacuum chamber is again closed over momentarily. In this way, a fiber ring present in the inside of the rotor cup can be more easily removed before the actual cleaning of the open-end spinning rotor.

14 Claims, 5 Drawing Sheets n
$n_B$
$n_k$
$n_e$
$t_1$
$t_k$
$t_3$
$t_6$
$t_7$
t
α
$\alpha_2$
$\alpha_1$
$t_2$
$t_k$
$t_3$
$t_4$
$t_5$
$t_6$
$t_7$
$t_8$
t

PROCESS AND APPARATUS FOR CLEANING AN OPEN-END SPINNING ROTOR

BACKGROUND AND SUMMARY OF THE INVENTION

This application claims the priority of German Application Number 199 56 264.4, filed in Germany, Nov. 23, 1999, the disclosure of which is expressly incorporated by reference herein.

The present invention relates to a process for cleaning an open-end spinning rotor, comprising a rotor cup having a fiber collecting groove and being arranged in a vacuum chamber, which, while leaving an air current transfer gap between the inside of the rotor cup and the vacuum chamber, can be closed over by a movable cover, which comprises an extension projecting into the inside of the rotor cup, which extension comprises a mouth of a fiber feed channel as well as a first part of a yarn withdrawal channel, and which extension can be removed from the inside of the rotor cup when the cover is moved away, said process comprising:

interruption of the fiber feed in the event of an end-break slowing down the open-end spinning rotor moving away of the cover from the vacuum chamber to insert cleaning elements into the rotor cup, and closing of the vacuum chamber after cleaning.

The present invention relates further to an apparatus for carrying out the process.

A process of this type is prior art in U.S. Pat. No. 4,825,631. In this process, the cleaning of the open-end spinning rotor is carried out in connection with an end break and a subsequent piecing process. After the fiber feed is interrupted, the open-end spinning rotor is slowed down by a traveling maintenance device, the rotor cup is uncovered by swivelling away a cover from the vacuum chamber for the purpose of inserting cleaning elements and after the completed cleaning, the vacuum chamber is closed.

The known process has in the past proved satisfactory in the case of rotors having standard dimensions, and made use of the fact that after the open-end spinning rotor was slowed down and before the cover was removed from the vacuum chamber, a fiber ring still located in the inside of the rotor cup was suctioned off by the air current transfer gap. It has been known for a long time from U.S. Pat. No. 3,481,129 that fibers, which, in the case of an end break, reach the inside of the rotor cup after fiber feed has been stopped, find—at reduced rotor speeds—their way to the operational suctioning as long as the vacuum chamber is still closed. The air current transfer gap must, however, have accordingly large dimensions, which is why it is suggested in the above mentioned patent that the extension of the cover which projects into the rotor cup is provided with a corresponding recess.

It has been shown in practice that, especially in the case of small rotor cups, whose fiber collecting grooves have a diameter of less than 30 mm, the fibers do not always find their way into the operational suctioning. An explanation for this is supplied in the non-generic German published patent application 41 31 684, whereby a fiber ring which is to be removed from the rotor cup can cling on to the extension of the cover which projects into the rotor cup. This publication deals, however, in contrast to the above mentioned prior art, with the cleaning of the open-end spinning rotor by means of air pressure and with a closed spinning aggregate.

The statement that fibers to be suctioned off can remain on the extension of the cover when the spinning aggregate is closed has been confirmed in practice. In particular in the case of synthetic fibers, the fiber ring located in the fiber collecting groove contracts somewhat due to its elasticity after the open-end spinning rotor has been slowed down, so that its diameter is reduced. The fiber ring thus reaches the extension of the cover and, after a time, can block the mouth of the fiber feed channel, so that a subsequent piecing process becomes impossible. A fiber ring located on the extension of the cover cannot be removed by normal cleaning elements after the cover has been moved aside, as the cleaning elements penetrate primarily into the inside of the rotor cup and are not arranged at the extension of the cover.

It is an object of the present invention to take measures to effectively prevent the fiber ring from remaining on the extension of the cover before the cover is actually moved aside for the purpose of inserting cleaning elements into the rotor cup.

This object has been achieved in accordance with the present invention in that before the actual moving aside of the cover for the purpose of inserting cleaning elements into the rotor cup, the following procedural steps are additionally carried out:

a momentary moving away of the cover from the vacuum chamber for the purpose of temporarily removing the extension from the inside of the rotor cup, before the open-end spinning rotor is so slowed down that the fibers present in the rotor cup are no longer held in the fiber collecting groove by the centrifugal forces, and a closing of the vacuum chamber after the fibers present in the rotor cup cannot be held any longer in the fiber collecting groove by centrifugal forces due to the further slowing down of the open-end spinning rotor.

According to the present invention, the extension, at a certain time at which the fiber ring is still held fast in the fiber collecting groove, is removed so far out of the rotor cup so that the fiber ring cannot cling on to the extension when it contracts in diameter as the centrifugal forces become weaker.

During the subsequent momentary re-closing of the vacuum chamber, the fiber ring thus reaches the operational suctioning device without any difficulties. The cover can then be moved aside in the usual way for the actual cleaning of the open-end spinning rotor.

The temporary re-closing of the vacuum chamber does not, of course, need to be carried out fully, and the cover does not need to be locked into its operational position again. It is sufficient to execute the closing movement only to such a degree that the suction effect of the vacuum chamber is again effective in the inside of the rotor cup. In practice, a ring seal applied to the cover can be disposed only lightly on the vacuum chamber.

The process can be carried out in principle in a number of different ways. For example, it is sufficient when the slowing down of the open-end spinning rotor is begun only during or after the momentary moving away of the cover from the vacuum chamber. This ensures in any case that the extension is removed from the rotor inside before the fiber ring collapses. Alternatively, it is, of course, possible to start the slowing down of the open-end spinning rotor before the temporary moving away of the cover from the vacuum chamber. In the latter case, the time lapse must be ensured so that the fiber ring is held completely in the fiber collecting groove until the extension has been moved out of the rotor cup. This is usually the case when the slowing down is started approximately 1.5 to 2 seconds before the cover is moved aside.

In order to ensure that the extension does not reach the rotor inside too early when the vacuum chamber is being closed, the temporary moving away of the cover from the vacuum chamber can be delayed until the open-end spinning rotor comes to a complete standstill.

In the case of an apparatus for carrying out the process, a maintenance device is advantageously arranged at the spinning aggregate, which maintenance device is provided with apparatus for activating a braking device, apparatus for opening and closing the vacuum chamber as well as apparatus for inserting cleaning elements in the rotor cup. The apparatus for opening and closing the vacuum chamber are coordinated, according to the present invention, with the apparatus for activating the braking device in such a way that (a) in the case of a partly slowed down open-end spinning rotor, the cover is moved far enough away from the vacuum chamber so that the extension is removed from inside of the rotor cup and that (b) after the open-end spinning rotor has come to a complete standstill, the vacuum chamber is again closed before (c) the cover is moved away from the vacuum chamber for the purpose of inserting the cleaning elements in the rotor cup.

Advantageously, the apparatus for activating the braking device comprises a brake lever and the apparatus for opening and closing the vacuum chamber comprises an opening lever. The brake lever and the opening lever are each connected to a cam disk drive. This results in a set arrangement of the individual timed sequences.

Other objects, advantages and novel features of the present invention will become apparent from the following detailed description of the invention when considered in conjunction with the accompanying drawings.

DETAILED DESCRIPTION OF THE DRAWINGS

Figure 1:
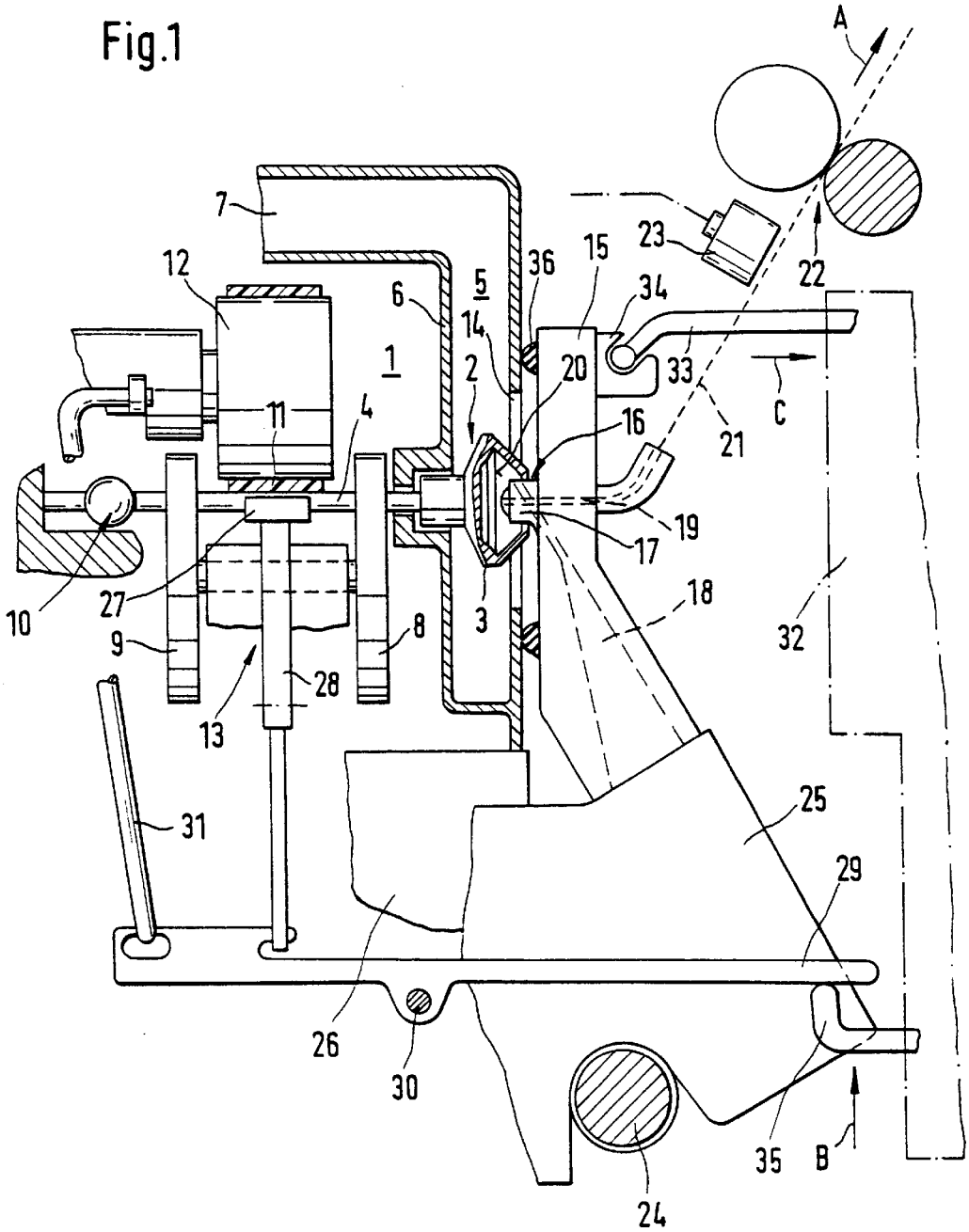
FIG. 1 is a part sectional side view of an open-end spinning aggregate constructed according to preferred embodiments of the invention, at which a cleaning of an open-end spinning rotor is to be carried out.

The spinning aggregate 1 shown in FIG. 1 comprises a known open-end spinning rotor assembly 2, which comprises in the usual way a rotor cup 3 and a shaft 4. The rotor cup 3 rotates during operation in a vacuum chamber 5, which is formed by a rotor housing 6. The vacuum chamber 5 is connected by a vacuum conduit 7 to a vacuum source (not shown).

The shaft 4 of open-end spinning rotor assembly 2 is in the known way supported radially on supporting disc pairs 8 and 9 and supported in axial direction against a step bearing 10. The shaft 4 is driven by a drive belt 11, for example a tangential belt extending in machine longitudinal direction. The drive belt 11 is loaded by a pressure roller 12 in the area of each individual spinning aggregate 1.

Furthermore, one braking device 13 per spinning aggregate is arranged at the respective open-end spinning rotor assembly 2.

The vacuum chamber 5 comprises towards the service side a front opening 14, through which the open-end spinning rotor assembly 2 can be pulled out for the purpose of maintenance or exchange. During operation, the front opening 14 of the vacuum chamber 5 is closed by a movable cover 15, which can be disposed with a sealing ring 36 on the rotor housing 6. During operation, the inside of the rotor cup 3 is connected by an air current transfer gap 16 with the vacuum source when the vacuum chamber 5 is closed.

The cover 15 comprises in the known way an extension 17, which projects during operation into the inside of the rotor cup 3. The extension 17 comprises the mouth of a fiber feed channel 18 as well as the first part of a yarn withdrawal channel 18. During operation, individual fibers, opened by an opening device, are fed through the fiber feed channel 18 onto an interior sliding wall of the rotor cup 3, from which the fibers reach in the known way a fiber collecting groove 20. The spun yarn 21, denoted only by a dotted line, is then withdrawn from the fiber collecting groove 20 through the yarn withdrawing channel 19 in delivery direction A by a delivery roller pair 22.

A stop motion yarn detector 23 of the spinning aggregate 1 is arranged at the yarn 21. The stop motion yarn detector 23 is connected by an electric wire, shown by a dot-dash line, with a coupling (not shown) belonging to each spinning aggregate 1, by which coupling the fiber feed is interrupted in the case of an end break, so that no more fibers can reach the inside of the rotor cup 3 through the fiber feed channel 18.

Figure 2:
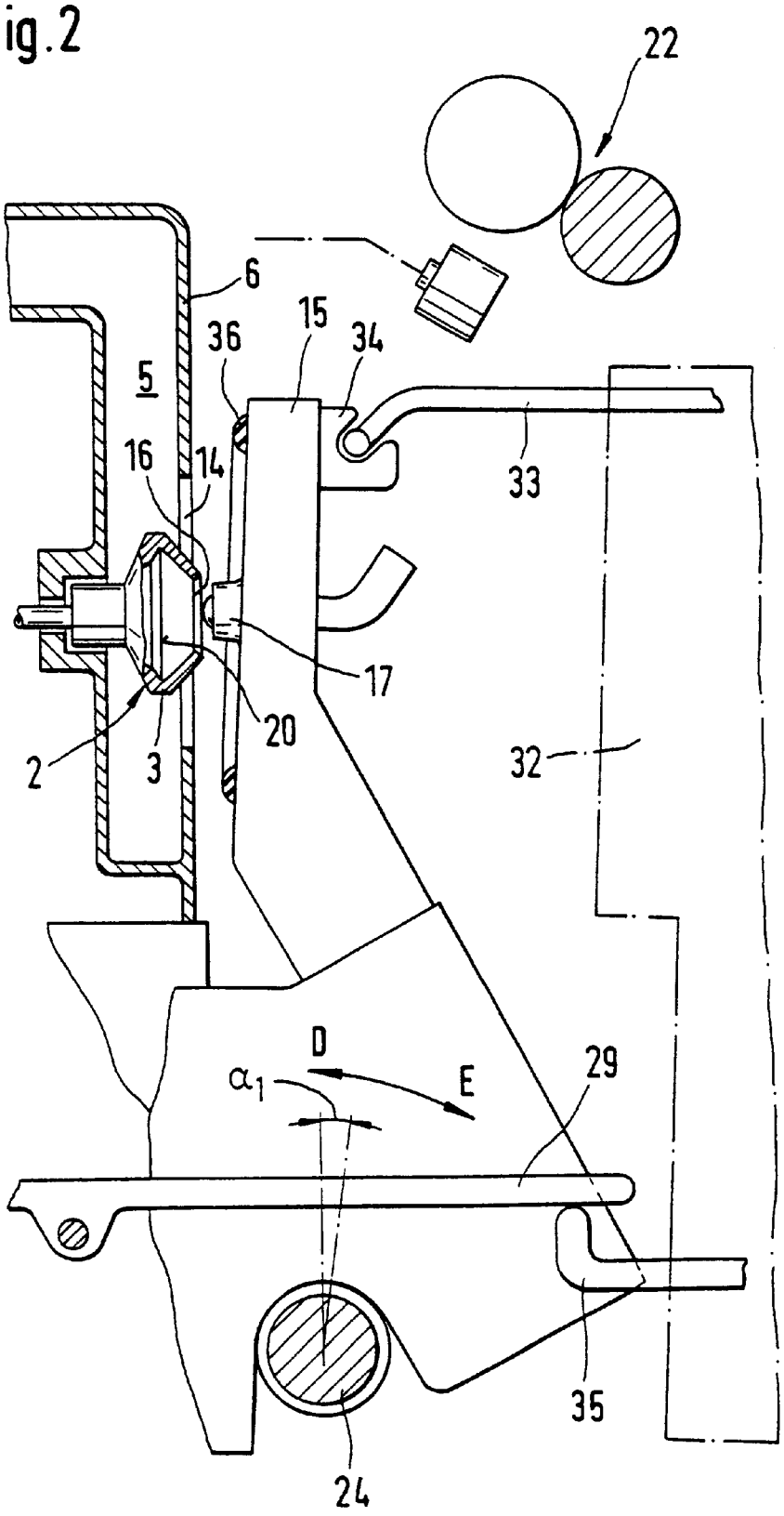
FIG. 2 is a partial view of FIG. 1, shown with an extension projecting into the rotor cup already moved out of the rotor cup.
Figure 3:
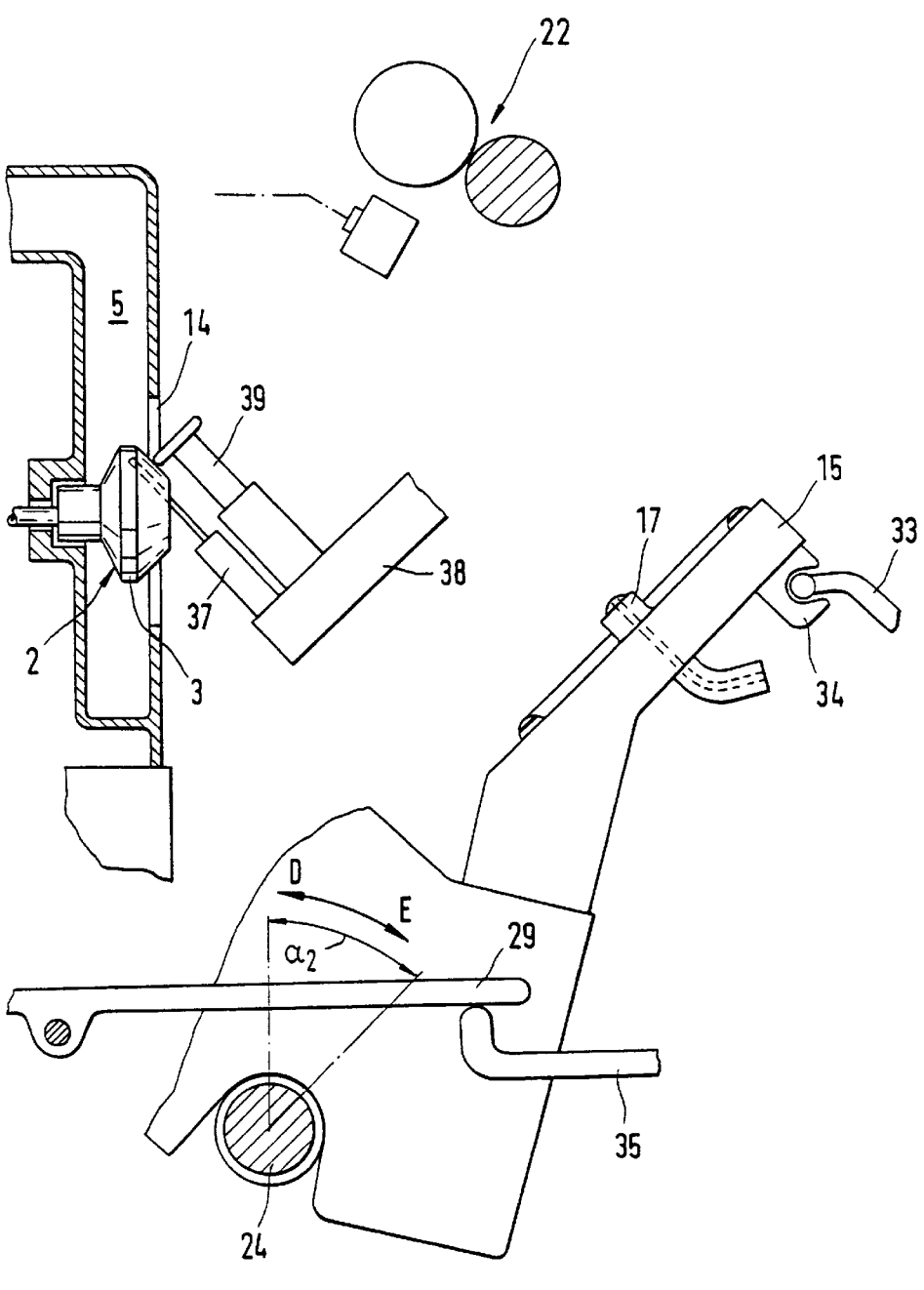
FIG. 3 is partial view similar to FIGS. 1 and 2, shown with the cover moved sufficiently far away from the vacuum chamber for the actual cleaning of the open-end spinning rotor.

For maintenance purposes, the cover 15 can be swivelled around a swivel axle 24 applied to the spinning aggregate 1, and can be swivelled according to the arrow directions D and E (FIGS. 2 and 3). The cover 15 is a component part of a housing 25, which contains the feed and opening devices for the spinning aggregate 1. The stationary part of the spinning aggregate 1 is denoted by the reference number 26.

The braking device 13 comprises a brake 27, which takes the form of a pincer brake and can be arranged at the shaft 4 on two sides below the drive belt 11. Thus the open-end spinning rotor assembly 2 of an individual spinning aggregate 1 can be slowed down when required despite the continuing drive of the remaining spinning aggregates.

The braking device 13 comprises a transfer mechanism 28, by means of which the brake 27 can be activated from the service side of the spinning aggregate 1. This activation occurs by way of an activating lever 29 which projects forwards out of the spinning aggregate 1, which lever 29 causes the braking of the shaft 4 of the open-end spinning rotor assembly 2 when it is raised in activating direction B. The activating lever 29 can for this purpose be swivelled around a swivel axle 30 of the spinning aggregate 1 and is connected, in addition with the brake 27, with the press roller 12 by a connecting rod 31. Thus, when the open-end spinning rotor 2 is braked, the press roller 12 is at the same time raised from the drive belt 11, so that the drive too is temporarily interrupted.

After an end break, the broken yarn 21 is pieced again in the known way by a traveling maintenance device 32, denoted here by a dot-dash line. This known piecing process is usually preceded by a cleaning of the inside of the rotor cup 3, as the piecing process is only successful when the fiber collecting groove 20 is free of remaining fibers.

The maintenance device 32 comprises an opening lever 33, which can be arranged at a locking device 34 applied to the cover 15, and which, for the purpose of moving the cover 15 away from the vacuum chamber 5, is movable in direction C. The maintenance device 32 comprises further a braking lever 35, which can raise the activating lever 29 of the spinning aggregate 1 according to the direction of action B.

In the case of an end break—or when the open-end spinning rotor 2 is to be cleaned preventatively—the fiber feed is first interrupted, in the case of an end break by the yarn detector 23 and the above mentioned coupling. When subsequently, with the spinning aggregate 1 still closed, the open-end spinning rotor 2 is slowed down by activating the activating lever 29, a fiber ring still present in the fiber collecting groove 20 usually reaches the suction connected to the vacuum chamber 5 by means of the air current transfer gap 16. This occurs without any difficulty when the front opening of the rotor cup 3 is sufficiently larger in diameter than the extension 17.

In particular in the case of small rotor cups 3, which are commonplace today as a result of ever increasing rotor speeds, the air current transfer gap 16 between the rotor cup 3 and the extension 17 is often extremely small. There is then the risk that despite the slowing down of the open-end spinning rotor 2, a fiber ring located in the inside of the rotor cup 3 cannot be completely suctioned off, but rather that the fiber ring settles on the extension 17 from the outside. This happens to a large extent in the case of synthetic fibers, which contract elastically when the centrifugal forces diminish as a result of the braking of the open-end spinning rotor 2, whereby the diameter of the fiber ring decreases in size.

The procedure according to the present invention is that always then, when the open-end spinning rotor 2 is slowed down from its operational speed, the extension 17 is moved at least so far away from the vacuum chamber 5 that it leaves the inside of the rotor cup 3. If the fiber ring collapses at low speeds of the open-end spinning rotor 2 or after its complete standstill, it can no longer settle on the extension 17. The settling of fibers on the extension 17 would mean that although the inside of the rotor cup 3 could be cleaned, the fibers from the extension 17 would not necessarily be easily removable during an automatic cleaning process.

As shown in FIG. 2, it is for this purpose according to the present invention that the cover 15 can be moved away by the amount of a small opening angle $\alpha_1$ from the vacuum chamber 5, namely at least so far that the extension 17 has entirely left the inside of the rotor cup 3. A further swivelling of the cover 15 would not be detrimental, but certainly superfluous.

The swivelling of the cover 15 as a preparation for a cleaning of the open-end spinning rotor 2 must occur as long as the speed of the open-end spinning rotor 2 is high enough to prevent the fibers held in the fiber collecting groove 20 as a result of the centrifugal forces from leaving the fiber collecting groove 20. When the cover 15 is moved away to the degree of the above mentioned small opening angle $\alpha_1$ from the vacuum chamber 5, the centrifugal forces can be reduced sufficiently by further slowing down of the open-end spinning rotor 2 so that the fiber ring collapses. It cannot wrap itself around the extension 17 from the outside. When the vacuum chamber 5 is subsequently closed and the cover 15 moves from a position according to FIG. 2 to a position according to FIG. 1, the collapsed fiber ring can then be sucked into the vacuum chamber 5 by way of the air current transfer gap 16. It is hereby sufficient to close the cover 15 only to such a degree that the sealing ring 36 is disposed lightly from the outside on the rotor housing 6.

When, as according to the present invention, the spinning aggregate 1 is temporarily opened and moves from its operational position according to FIG. 1 into the intermediary position according to FIG. 2, and is subsequently closed again in the position according to FIG. 1, then the actual cleaning of the open-end spinning rotor 2 according to FIG. 3 can take place. For this, the cover 15 is swivelled around a large opening angle $\alpha_2$ from the vacuum chamber 5, namely so far that cleaning elements 37 of the maintenance device 32 can be inserted into the rotor cup 3. Apparatus 38 for inserting the cleaning elements 37 are provided. During this actual cleaning process, the open-end spinning rotor 2 is, as explained above, braked, that is, it is decoupled from its actual drive. As it is advantageous to drive the rotor cup 3 at a very low speed during the cleaning process, an external rotor drive 39 of the maintenance device 32 is provided. The rotor speed must, of course, be so low during the cleaning process that fiber waste cannot remain by means of centrifugal forces in the fiber collecting groove 20. After the cleaning process is completed, the cover 15 is again moved to the vacuum chamber 5 in arrow direction D, so that the spinning aggregate 1 is closed again for the actual piecing process. The piecing process is known from prior art and is not a part of the present invention.

Figure 4:
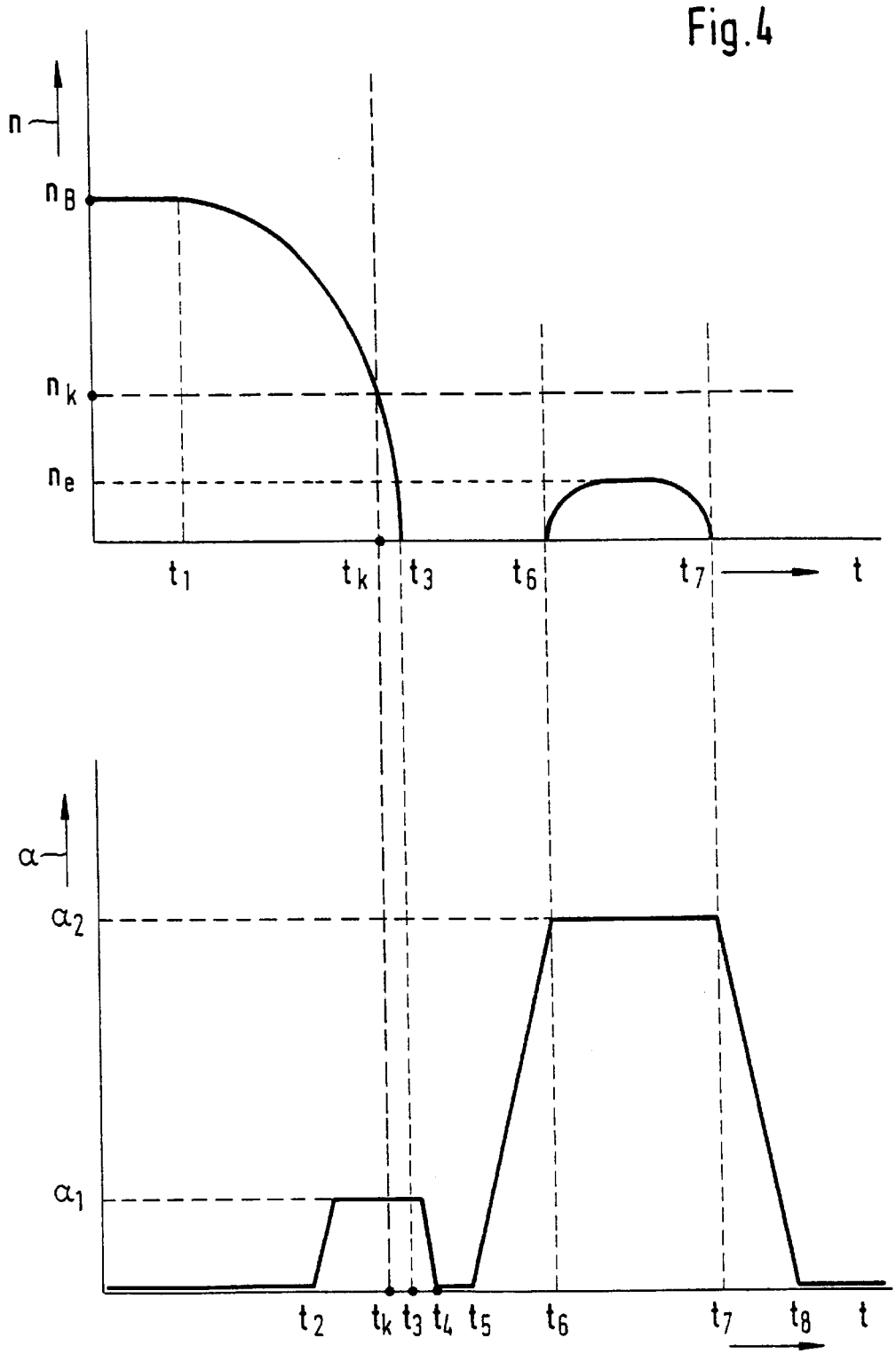
FIG. 4 is a diagram showing the sequence of events according to the present invention.

With the aid of FIG. 4, the timing of the additional procedural steps according to the present invention are explained.

The time sequence diagram according to FIG. 4 consists of two separate diagrams, whereby in the upper diagram the speed n of the open-end spinning rotor 2 is entered over the time t and in the lower diagram the opening angle $\alpha$ of the cover 15 is entered over the time t.

It is now supposed that at the beginning, the open-end spinning rotor 2 still has an operational speed of $n_B$, even after an end break. The fiber feed is already switched off. Beginning from a time $t_1$, the maintenance device 32 now arranged at the spinning aggregate 1 begins its activities, and the open-end spinning rotor 2 is now braked, as can been seen from the drop in the speed curve. At a time $t_3$, the open-end spinning rotor 2 is, according to our supposition, at a complete standstill.

Between the operational speed $n_B$ and the standstill of the open-end spinning rotor 2, there is a critical speed $n_K$, at which the centrifugal forces are still so strong that the fiber ring remains in the fiber collecting groove 20 during rotation of the rotor cup 3. Left of the time $t_K$, which is arranged at the critical speed $n_K$, the fibers remain in the fiber collecting groove 20, to the right of the time $t_K$, the fibers leave the fiber collecting groove 20 due to diminishing centrifugal forces. The critical speed $n_K$ is, of course, variable over a certain range, depending on the fiber material or the size of the rotor cup 3.

According to the present invention, the extension 17 must now be moved out of the rotor cup 3, before the rotor speed n has sunk to its critical speed $n_k$. At the time $t_2$, which must lie left of the time $t_k$, the vacuum chamber 5 is opened at the small opening angle $\alpha_1$. When the fiber ring now collapses, it cannot cling on anymore from the outside to the extension 17 of the cover 15. The vacuum chamber 5 remains open until the open-end spinning rotor 2 comes to a complete standstill, or in any case for so long until the critical time $t_k$ has passed. It is presumed, that at a time $t_4$ the vacuum chamber 5 is closed again by means of the cover 15. Thus a collapsed fiber ring, located in the inside of the rotor cup 3 can, by way of the air current transfer gap 16, reach the vacuum chamber 5 and the suction device.

Subsequent to these procedural steps according to the invention, the vacuum chamber 5 can now be uncovered by means of a wide opening of the cover 15 to the opening angle $\alpha_2$ for the actual cleaning process of the open-end spinning rotor 2. It is hereby purposeful when the above mentioned external slow rotor drive 39 drives the rotor cup 3 to rotate slowly. This external low rotor speed $n_e$ must, of course, be significantly slower than the critical speed $n_K$. It is presumed that this is the case between the times $t_6$ and $t_7$, during which times the cover 15 is swivelled open at a wide angle.

After the cleaning of the open-end spinning rotor 2 is completed, the spinning aggregate 1 is closed again at a time $t_8$ for the piecing process.

Figure 5:
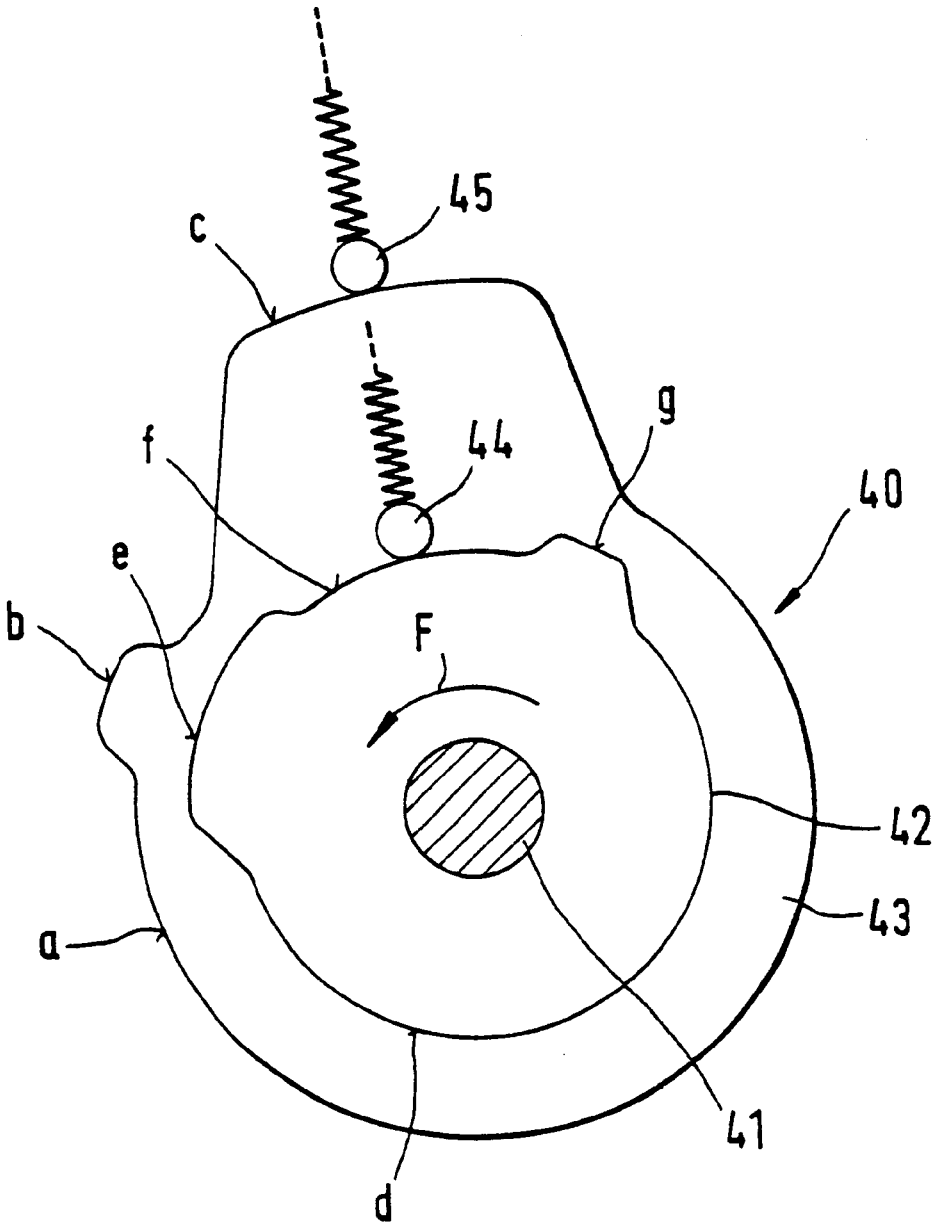
FIG. 5 is a cam-disk drive for realizing the timed sequence of events according to the diagram of FIG. 4.

For the time sequence control of the procedural steps according to the present invention, a cam disc drive 40 can be provided (FIG. 5). For this a drive shaft 41, driven in rotational direction F, is provided. There is, in addition to other cam discs (not shown), a cam disc 42 for the brake lever 35 as well as a cam disc 43 for the opening lever 33. Spring loaded cams 44 und 45 act together with these cam discs 42 and 43, whereby the cam 44 is related to the means for activating the braking device 13 and the cam 45 is related to the structure for opening and closing the cover 15.

Three diameter areas a, b and c can be seen on the cam disc 43 for the opening lever 33, while on the cam disc 42 for the braking lever 35 four diameter areas d, e, f and g can be seen. The diameter area a belongs to that position of the opening lever 33 in which the vacuum chamber 5 is closed by the cover 15. The diameter area b belongs to the small opening angle $\alpha_1$, the diameter area c to the large opening angle $\alpha_2$. In the same way, the diameter area d belongs to the cam disc 42 for the unbacked state of the open-end spinning rotor 2, and the identical diameter areas e and g are provided for the actual braking of the open-end spinning rotor 2. The diameter area f measures in diameter in the range between the diameter area d and the diameter areas e and g, and is associated only with a light activating of the braking lever 35, in which the pressure roller 12 is raised from the shaft 4, but the brake 27 is not yet placed to the shaft 4.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. A process for cleaning an open-end spinning rotor assembly (2), comprising a rotor cup (3) having a fiber collecting groove (20) and being arranged in a vacuum chamber (5), which, while leaving an air current transfer gap (16) between an inside of the rotor cup (3) and the vacuum chamber (5), can be closed over by a movable cover (15), which cover comprises an extension (17) projecting into the inside of the rotor cup (3), which extension (17) comprises a mouth of a fiber feed channel (18) as well as a first part of a yarn withdrawal channel (19), and which can be removed from the inside of the rotor cup when the cover (15) is removed, said process comprising the following procedural steps:

interruption of the fiber feed in the event of an end-break;

slowing down the open-end spinning rotor (2);

moving away of the cover (15) from the vacuum chamber (5) to insert cleaning elements (37) into the rotor cup (3) as well as closing of the vacuum chamber (5) after cleaning;

wherein, before the actual moving away of the cover (15) for the purpose of inserting cleaning elements (37) into the rotor cup (3), the following procedural steps are additionally carried out:

a temporary moving away of the cover (15) from the vacuum chamber (5) for the purpose of temporarily removing the extension (17) from the inside of the rotor cup (3), before the open-end spinning rotor (2) is slowed down to such an extent that the fibers present in the rotor cup (3) are no longer held in the fiber collecting groove (20) by the centrifugal forces; and a closing of the vacuum chamber (5) after the fibers present in the rotor cup (3) cannot be held any longer in the fiber collecting groove (20) by centrifugal forces due to the further slowing down of the open-end spinning rotor (2).

2. A process according to claim 1, wherein the closing movement to close the vacuum chamber (5) is carried out only to such an extent that the suction action of the vacuum chamber (5) is again effective in the inside of the rotor cup (3).

3. A process according to claim 1, wherein the braking of the open-end spinning rotor assembly (2) is begun only during or after the temporary moving away of the cover (15) from the vacuum chamber (5).

4. A process according to claim 2, wherein the braking of the open-end spinning rotor assembly (2) is begun only during or after the temporary moving away of the cover (15) from the vacuum chamber (5).

5. A process according to claim 1, wherein the braking of the open-end spinning rotor assembly (2) is begun approximately 1.5 to 2 seconds before the temporary moving away of the cover (15) from the vacuum chamber (5).

6. A process according to claim 2, wherein the braking of the open-end spinning rotor assembly (2) is begun approximately 1.5 to 2 seconds before the temporary moving away of the cover (15) from the vacuum chamber (5).

7. A process according to claim 1, wherein the temporary moving away of the cover (15) from the vacuum chamber (5) is maintained until the open-end spinning rotor assembly (2) has come to a standstill.

8. A process according to claim 2, wherein the temporary moving away of the cover (15) from the vacuum chamber (5) is maintained until the open-end spinning rotor assembly (2) has come to a standstill.

9. A process according to claim 3, wherein the temporary moving away of the cover (15) from the vacuum chamber (5) is maintained until the open-end spinning rotor assembly (2) has come to a standstill.

10. A process according to claim 4, wherein the temporary moving away of the cover (15) from the vacuum chamber (5) is maintained until the open-end spinning rotor assembly (2) has come to a standstill.

11. A process according to claim 5, wherein the temporary moving away of the cover (15) from the vacuum chamber (5) is maintained until the open-end spinning rotor assembly (2) has come to a standstill.

12. A process according to claim 6, wherein the temporary moving away of the cover (15) from the vacuum chamber (5) is maintained until the open-end spinning rotor assembly (2) has come to a standstill.

13. Apparatus for carrying out a process for cleaning an open-end spinning rotor assembly (2) at a spinning unit comprising:

an open-end spinning rotor assembly (2), comprising a rotor cup (3) with a fiber collecting groove (20), a vacuum chamber (5) surrounding the rotor cup (3), a movable cover (15) operable to close the vacuum chamber (5) while leaving an air current transfer gap

(16) between the inside of the rotor cup (3) and the vacuum chamber (5), an extension (17) arranged on the cover (15) and projecting during spinning into the inside of the rotor cup (3) and comprising a mouth of a fiber feed channel (18) and an initial part of a yarn withdrawal channel (19), a stop motion yarn detector (23) for interrupting the fiber feed in the case of an end break, a braking device (13) for braking the rotatably driven open-end spinning rotor assembly (2), and a maintenance device (32) adapted to be selectively arranged at the spinning aggregate (1), which maintenance device (32) is provided with apparatus for activating the braking device (13), apparatus for opening and closing the vacuum chamber (5), and apparatus inserting cleaning elements (37) in the rotor cup (3), wherein the apparatus for opening and closing the vacuum chamber (5) and the apparatus for activating the braking device (13) are adapted to one another in such a way that (a) in the case of a partly slowed down open-end spinning rotor (2), the cover (15) is temporarily moved far enough away from the vacuum chamber (5) so that the extension (17) is removed from inside of the rotor cup (3), and (b) after the open-end spinning rotor (2) has come to a complete standstill, the vacuum chamber (5) is again closed before the cover (15) is moved aside from the vacuum chamber (5) for the purpose of inserting the cleaning elements (37) in the rotor cup (3).

14. An apparatus according to claim 13, wherein the apparatus for activating the braking device (13) comprises a brake lever (35) and the apparatus for opening and closing the vacuum chamber (5) comprises an opening lever (33), and wherein the brake lever (35) and the opening lever (33) are each connected to a cam disc drive (40).

* * * * *